US006956595B1

(12) United States Patent
Yagi et al.

(10) Patent No.: US 6,956,595 B1
(45) Date of Patent: Oct. 18, 2005

(54) LIGHT SHUTTER DEVICE AND A DRIVING METHOD THEREOF

(75) Inventors: Tsukasa Yagi, Kobe (JP); Ken Matsubara, Takatsuki (JP); Tatsuya Kanazawa, Sakai (JP); Tomohiko Masuda, Otsu (JP)

(73) Assignee: Minolta Co., LTD, Osaka (JP)

( * ) Notice: Subject to any disclaimer, the term of this patent is extended or adjusted under 35 U.S.C. 154(b) by 1021 days.

(21) Appl. No.: 09/665,915

(22) Filed: Sep. 20, 2000

(30) Foreign Application Priority Data

Sep. 21, 1999 (JP) ..... 11-266829

(51) Int. Cl.[7] ..... B41J 2/47
(52) U.S. Cl. ..... 347/239; 347/255
(58) Field of Search ..... 347/135–136, 347/128, 237, 239, 247, 258, 142–144, 255; 355/71; 359/245, 246

(56) References Cited

U.S. PATENT DOCUMENTS 4,902,111 A 2/1990 Matsubara et al. ..... 359/254
4,932,761 A * 6/1990 Shingaki et al. ..... 359/246
5,093,676 A 3/1992 Matsubara et al. ..... 347/136
5,155,618 A * 10/1992 Matsubara et al. ..... 359/245
6,081,321 A * 6/2000 Miyagawa ..... 355/71

FOREIGN PATENT DOCUMENTS

JP 10-175326 A 6/1998
JP 10-333107 A 12/1998

* cited by examiner

*Primary Examiner*—Hai Pham
(74) *Attorney, Agent, or Firm*—Sidley Austin Brown & Wood LLP

(57) ABSTRACT

While light of R, G and B is switched from one to another and directed to a plurality of light shutter elements made of PLZT, a voltage is applied in accordance with image data between individual electrodes for the respective light shutter elements and a common electrode for all the light shutter elements. While a half-wave voltage Vr for light of R is applied to the individual electrodes, the voltage applied to the common electrode is altered to 0V, Vr-Vg and Vr-Vb in synchronization with switch of the three primary colors so that half-wave voltages for the respective colors can be applied to the light shutter elements.

15 Claims, 11 Drawing Sheets

LIGHT SHUTTER DEVICE AND A DRIVING METHOD THEREOF

This application is based on application No. 11-266829 filed in Japan, the content of which is hereby incorporated by reference.

BACKGROUND OF THE INVENTION

1. Field of the Invention

The present invention relates to a light shutter device and a driving method thereof, and more particularly to a light shutter device which has light shutter elements made of a material with an electro-optical effect such as PLZT to write an image on a photosensitive recording medium and a method of driving such a device.

2. Description of Related Art

As means of writing an image (latent image) on a silver salt photographic paper or film or on a photosensitive member for electrophotography, there have been suggested various kinds of light shutter devices which employ light shutter elements made of a material with an electro-optical effect such as PLZT and which turn on and off the light shutter elements individually.

In such a light shutter device, when a voltage is applied to a PLZT light shutter element, the PLZT causes birefringence, and light which is incident to the element via a polarizer located before the element is emergent from an analyzer located after the element. The polarizer and the analyzer are arranged to cross Nicol (are arranged in such a way that the direction of polarization of the polarizer and the direction of polarization of the analyzer will cross at 90 degrees to each other). The plane of polarization of the polarizer and the plane of polarization of the analyzer are at 45 degrees to the direction of electric field acting on the light shutter element.

In order to write a full-color image, color filters of R, G and B, which are the three primary colors, are switched in order during irradiation of the light shutter elements, so that a silver salt film is exposed to light of R, light of G and light of B separately line by line.

Incidentally, as FIG. 11 shows, with respect to a light shutter element made of PLZT, the relationship between light transmittance and voltage applied thereto changes according to whether the light is of red, green or blue. The voltage to achieve the maximum light transmittance is referred to as a half-wave voltage. Supposing that the half-wave voltages for red light, for green light and for blue light are Vr, Vg and Vb respectively, Vr>Vg>Vb. In order to obtain a full-color image of high quality, the driving voltage of the light shutter elements shall be switched to Vr, Vg and Vb for red, green and blue, respectively.

In Japanese Patent Laid Open Publication No. 10-333107, the Japanese applicants suggested a device which switches the voltage applied to the driver IC for the light shutter elements in synchronization with the light incidence of the three primary colors. However, the switching of a high voltage to be applied to the driver IC is influenced by the capacity of a bypass capacitor or the like, it is difficult to switch the voltage at a high speed.

SUMMARY OF THE INVENTION

An object of the present invention is to provide a light shutter device in which the driving voltage of light shutter elements can be speedily switched between values suitable for light of the three primary colors and a method of driving such a device.

Another object of the present invention is to provide a light shutter device in which not only the above object can be achieved but also variation of the half-wave voltages during continuous long-time operation is minimized so as to obtain fixed light transmittance and a method of driving such a device.

Further, another object of the present invention is to provide a light shutter device in which not only the above objects can be achieved but also the driving voltage of light shutter elements has a good rising characteristic and a method of driving such a device.

In order to attain the objects, a light shutter device according to the present invention comprises: a light source which emits light of a plurality of colors switching from one to another in order; a plurality of light shutter elements made of a material with an electro-optical effect, said light shutter elements controlling in accordance with image data whether to transmit or not to transmit the light which has been emitted from the light source and is incident to the light shutter elements; and a driver for driving the light shutter elements, said driver altering a driving condition in synchronization with switch of the colors of the light source.

In the light shutter device according to the present invention, light of a plurality of colors is incident to a plurality of the light shutter elements with the colors switched from one to another in order, and a driving voltage is applied between each individual electrode and a common electrode in accordance with image data. In synchronization with switch of the colors, a driving condition of the light shutter elements is altered. Specifically, to the individual electrodes, a voltage is applied fixedly during radiation of light of all the three primary colors. The voltage is, for example, the highest of the respective half-wave voltages for red, green and blue, that is, the half-wave voltage Vr for red. On the other hand, to the common electrode, in synchronization with color switch away R, G and B, optimal voltage for the colors, for example, 0V, Vr-Vg and Vr-Vb are applied.

In the driving method according to the present invetion, merely by altering the potential of the common electrode within a low level, the voltage applied to the light shutter elements can be switched between optimal voltages (half-wave voltages) for the three primary colors at a high speed. Consequently, a full-color image of high quality can be formed.

In the light shutter device according to the present invention, preferably, the electric field acting on the light shutter elements is inverted at specified cycles. If a unidirectional electric field continuously acts on the light shutter elements, fatigue of the light shutter elements occurs, that is, the half-wave voltages of the light shutter elements vary. By inverting the electric field at specified cycles, such fatigue can be prevented.

Moreover, in the light shutter device according to the present invention, it is preferred to superimpose a spike pulse voltage at a start of applying a driving voltage to the light shutter elements. Thereby, the rising characteristic of the driving voltage can be improved, which brings a possibility of lowering the driving voltage and improves the picture quality.

BRIEF DESCRIPTION OF THE DRAWINGS

These and other objects and features of the present invention will be apparent from the following description with reference to the accompanying drawings, in which.

DETAILED DESCRIPTION OF THE PREFERRED EMBODIMENTS

Embodiments of a light shutter device and a driving method thereof are described with reference to the accompanying drawings.

Structure of Light Shutter Device

Figure 1:
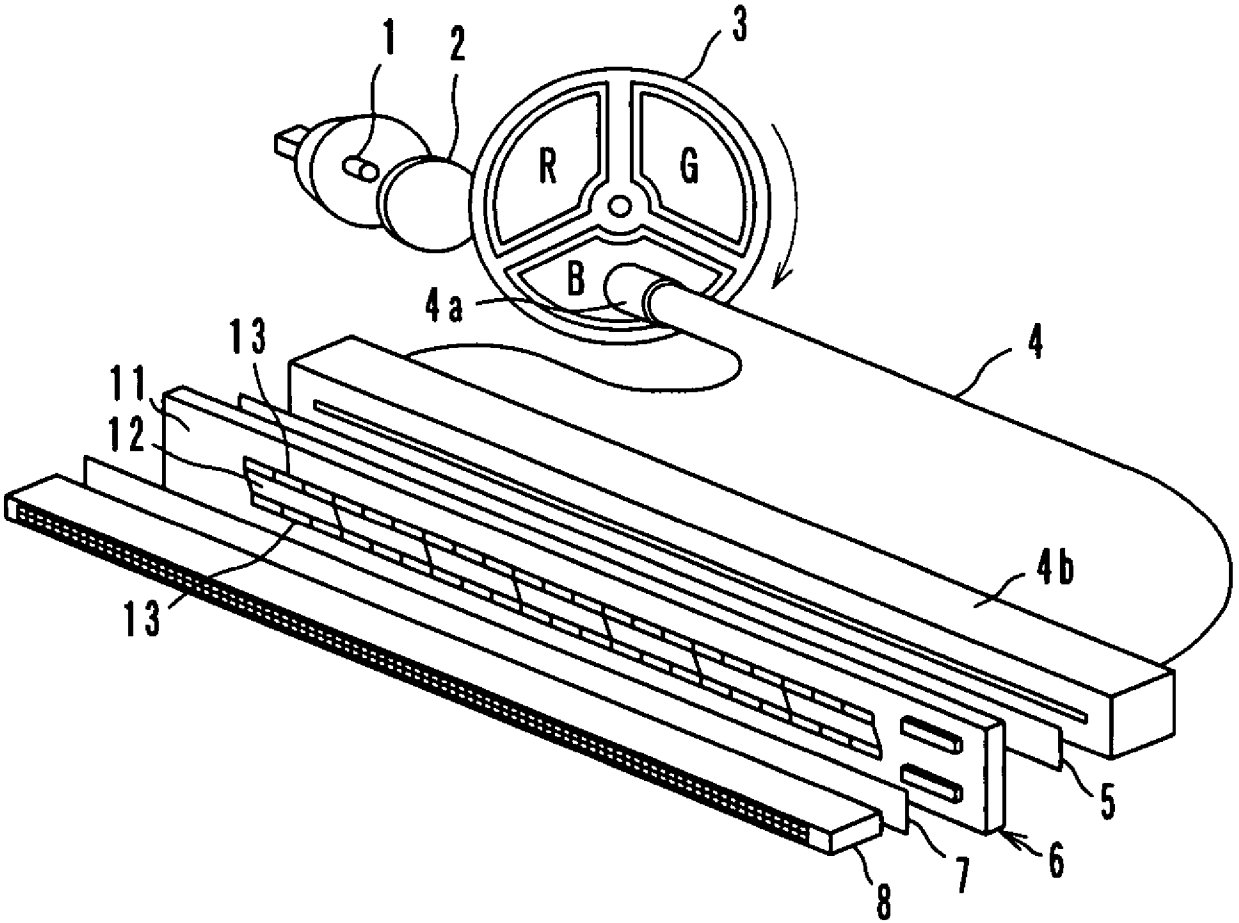
FIG. 1 is a schematic view of a light shutter device according to the present invention.

Referring to FIG. 1, a light shutter device according to the present invention is described. This device comprises a light source (halogen lamp) 1, a heat filter 2, a color filter 3, an optical fiber array 4, a polarizer 5, a light shutter module 6, an analyzer 7 and an imaging lens array 8.

The color filter 3 is a rotary disk which has three filter sections which transmit light of the three primary colors, namely, R, G and B, respectively. The color filter 3 is driven to rotate in synchronization with one-line writing by use of light shutter elements, which will be described later. The optical fiber array 4 is a bundle of a large number of optical fibers. Light emitted from the light source 1 is incident to the optical fiber array 4 through its incidence end 4*a* via the heat filter 2 and is emergent therefrom linearly through the other end 4*b*. The polarizer 5 and the analyzer 7 are arranged to cross Nicol, and the plane of polarization of the polarizer 5 and the plane of polarization of the analyzer 7 are at 45 degrees to the direction of electric field applied to the light shutter elements.

Figure 2:
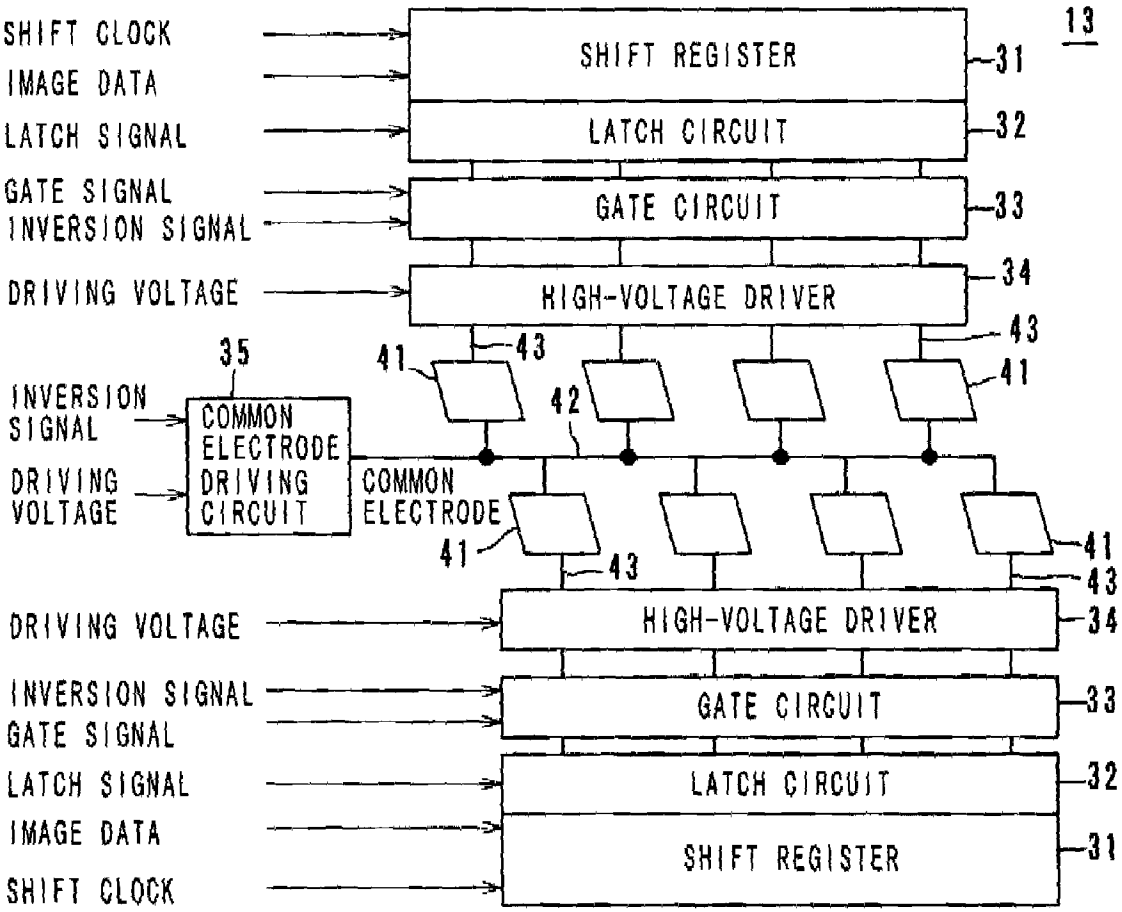
FIG. 2 is a block diagram which shows a driving circuit of the light shutter device.

The light shutter module 6 has a plurality of PLZT light shutter chips 12 and a plurality of driving circuits 13 on a ceramic substrate 11 with a slit or a glass substrate. In each of the light shutter chips 12, a large number of light shutter elements, each of which corresponds to a pixel, are formed. As FIG. 2 shows, the light shutter elements 41 are arranged in two rows alternately, and the two rows of light shutter elements 41 form one line in a main scanning direction.

PLZT, as is well known, is a light-transmitting ceramic material which has a large Kerr constant and an electro-optical effect. Light which is polarized linearly by the polarizer 5 is incident to each of the light shutter elements 41. At this time, when the voltage applied to the light shutter element 41 is turned on, the plane of polarization is rotated, and the light is emergent from the analyzer 7. When the voltage is off, the plane of polarization is not rotated, and the light is cut by the analyzer 7.

Thus, by turning on and off the voltages applied to the light shutter elements 41 individually, the light is transmitted or cut pixel by pixel, and the light emergent from the analyzer 7 is imaged on a photosensitive member (not shown) via the imaging lens array 8. The light shutter elements 41 are turned on and off in accordance with image data (main scanning) line by line, while the photosensitive member is moved in a direction (sub scanning), and thereby, a two-dimensional image is formed on the photosensitive member.

Driving Circuit

Figure 3:
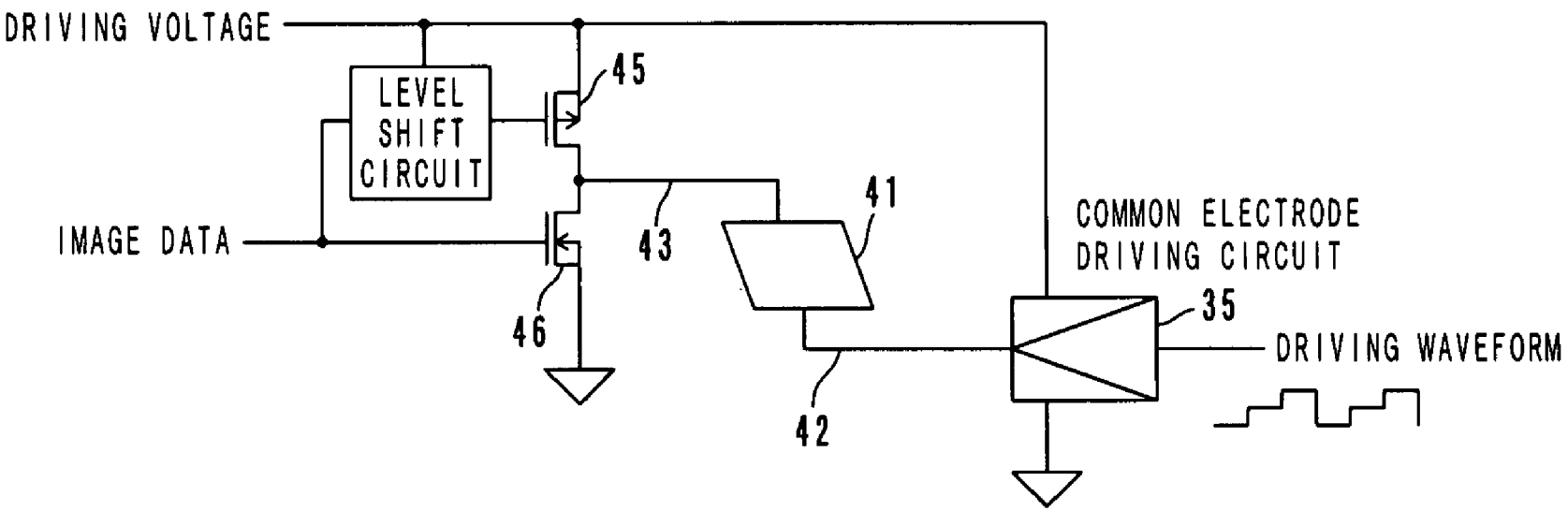
FIG. 3 is a block diagram which shows a high-voltage driver and a common electrode driving circuit included in the circuit shown by FIG. 2.

As FIG. 2 shows, each of the driving circuits 13 comprises a shift register 31, a latch circuit 32, a gate circuit 33, a high-voltage driver 34 and a common electrode driving circuit 35. Individual electrodes 43 for the respective light shutter elements 41 are connected to the high-voltage driver 34, and a common electrode 42 is grounded via the common electrode driving circuit 35. The high-voltage driver 34, as FIG. 3 shows, has two switching elements 45 and 46. When the switching element 45 is turned on, a driving voltage is applied to the individual electrodes 43 of the light shutter elements 41. When the switching element 46 is turned on, the individual electrodes 43 are grounded.

Referring back to FIG. 2, image data for one line are transmitted to the shift register 31 in synchronization with a shift clock and latched in the latch circuit 32 in response to turning-on of a latch signal. When a gate signal is on, the image data are transmitted to the high-voltage driver 34 together with an inversion signal. When the inversion signal is off (non-inversion), a driving voltage is applied to the individual electrodes 43. When the inversion signal is on (inversion), the individual electrodes 43 are grounded.

The common electrode driving circuit 35 comprises a high-speed/high-voltage amplifier which amplifies a driving waveform inputted thereto with a specified gain. In this embodiment, the amplifier amplifies the inversion signal to the level of the driving voltage and applies the amplified signal to the common electrode 42. The common electrode driving circuit 35, at the time of non-inversion, grounds the common electrode 42 and, at the time of inversion, applies a driving voltage to the common electrode 42.

With the driving circuit 13 of this structure, when the inversion signal is off, the common electrode 42 has the ground potential, and in this state, by applying a driving voltage to the individual electrodes 43, the light shutter elements 41 are turned on. The electric field at this time is referred to as a normal electric field (non-inverted electric field). On the other hand, when the inversion signal is on, the individual electrodes 43 have the ground potential, and in this state, by applying a driving voltage to the common electrode 42, the light shutter elements 41 are turned on. The electric field at this time is referred to as a reverse electric field (inverted electric field).

Figure 4:
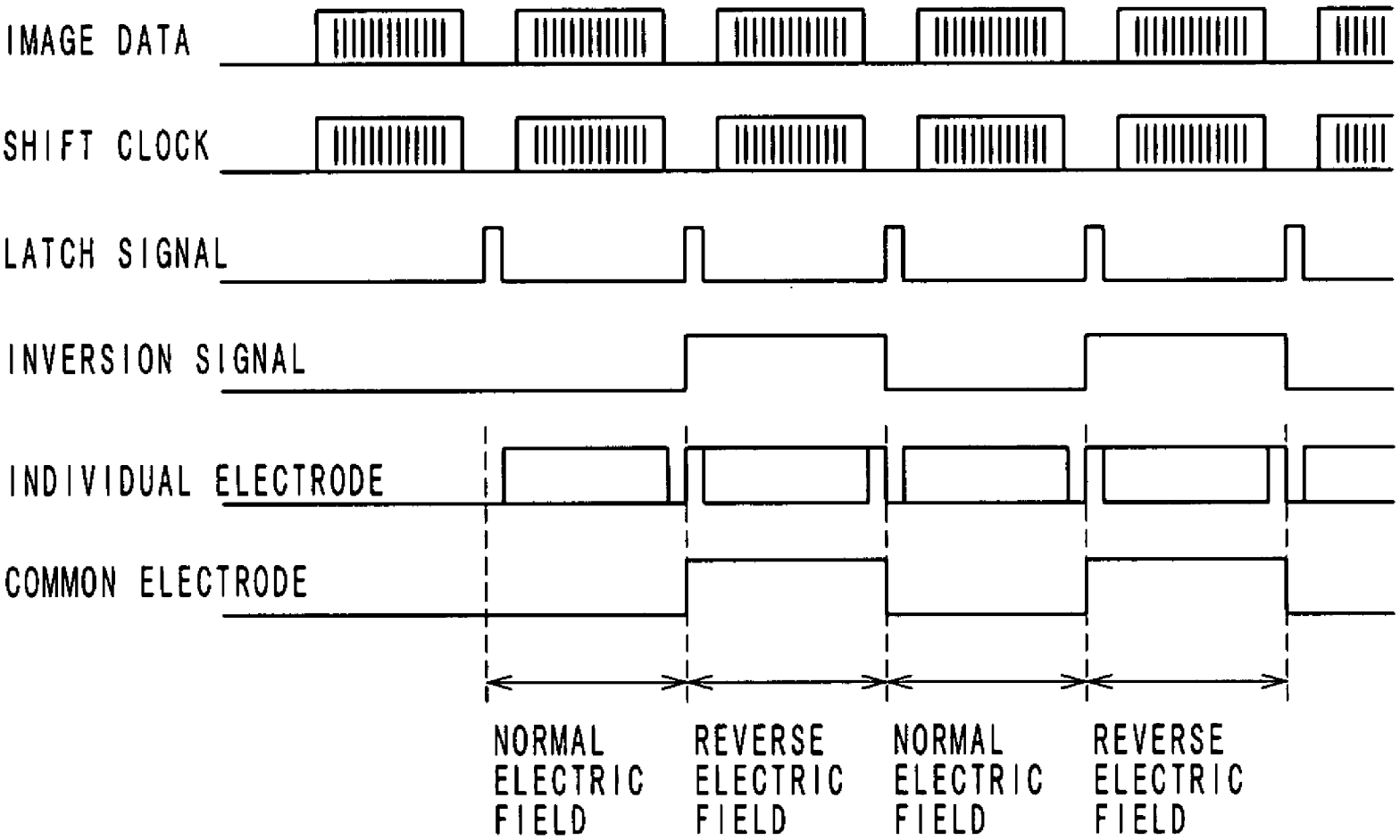
FIG. 4 is a timing chart which shows operation of the driving circuit.

FIG. 4 is a timing chart which shows switching of the electric field. In the example of FIG. 4, the inversion signal is switched on and off for every one-line writing. As is well known, if a unidirectional electric field is continuously applied to the PLZT light shutter elements 41, a fatigue phenomenon occurs, that is, the half-wave voltages shift. However, by inverting the electric field at specified cycles, the fatigue phenomenon can be prevented. In the example of FIG. 4, the non-inversion/inversion rate is 50/50. This rate can be arbitrarily designed; however, by switching the electric field between non-inversion and inversion at a rate of 50 to 50, the shift of the half-wave voltages of the light shutter elements 41 can be effectively suppressed.

In the example of FIG. 4, at the time of inversion, the inversion signal is amplified so that a voltage equal to the driving voltage applied to the individual electrodes 43 at the time of non-inversion can be applied to the common electrode 42. It is, however, possible to apply a desirable voltage to the common electrode 42 by changing the driving waveform. An electric field with a strength corresponding to the potential difference between the individual electrodes 43 and the common electrode 42 acts on the light shutter elements 41.

This driving method in which the electric field applied to the light shutter elements 41 is inverted at specified cycles are referred to as an electric field inversion method. On the other hand, it is possible to drive the light shutter elements 41 by applying a driving voltage to the individual electrodes 43 while connecting the common electrode 42 to the ground at all times. This driving method is referred to as a unidirectional electric field method.

First Embodiment of Driving Method

Figure 5:
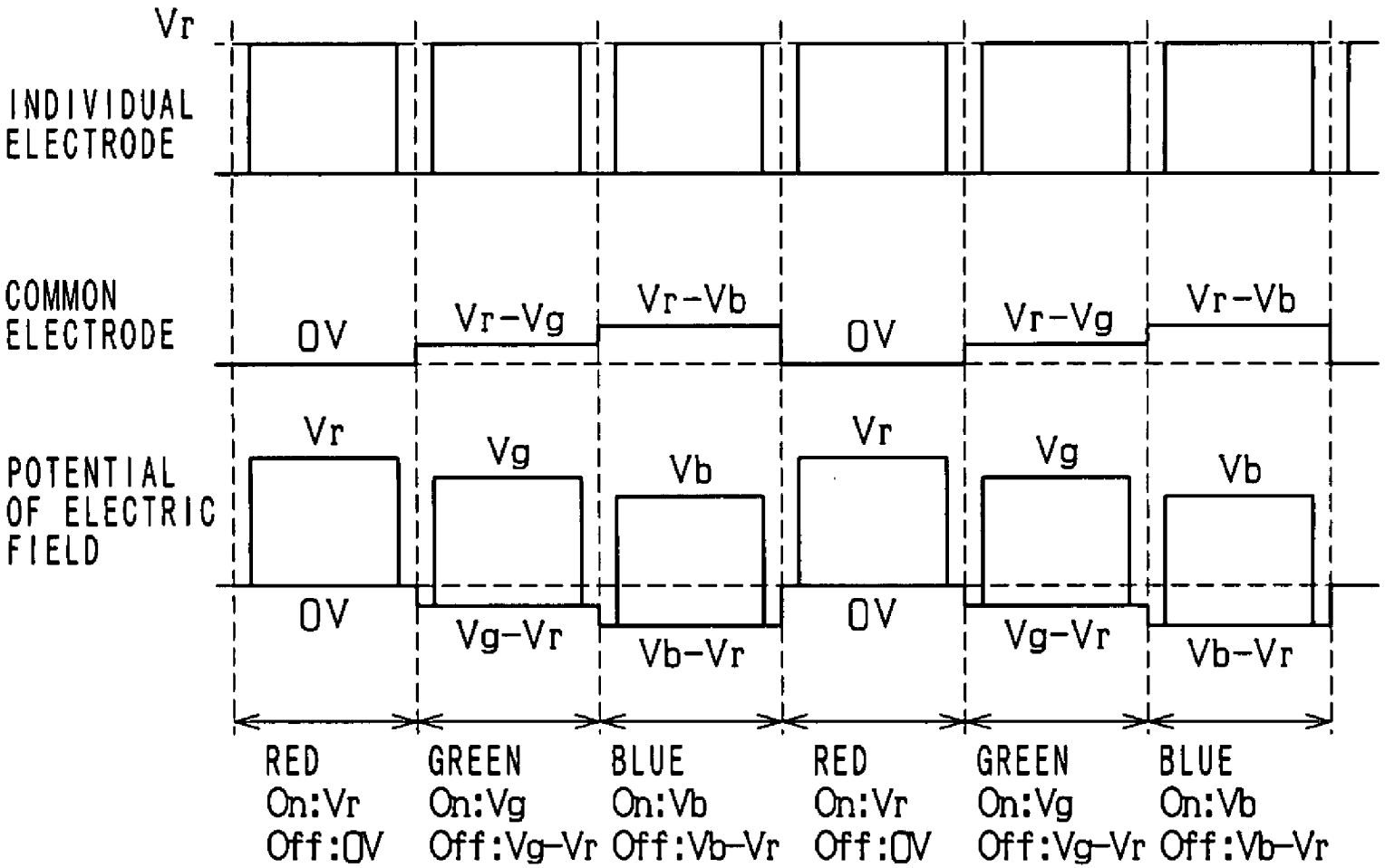
FIG. 5 is a timing chart which shows a first embodiment of a driving method according to the present invention.

As FIG. 5 shows, in the first embodiment, the unidirectional electric field method is adopted, and the voltage applied to the common electrode is altered.

Figure 11:
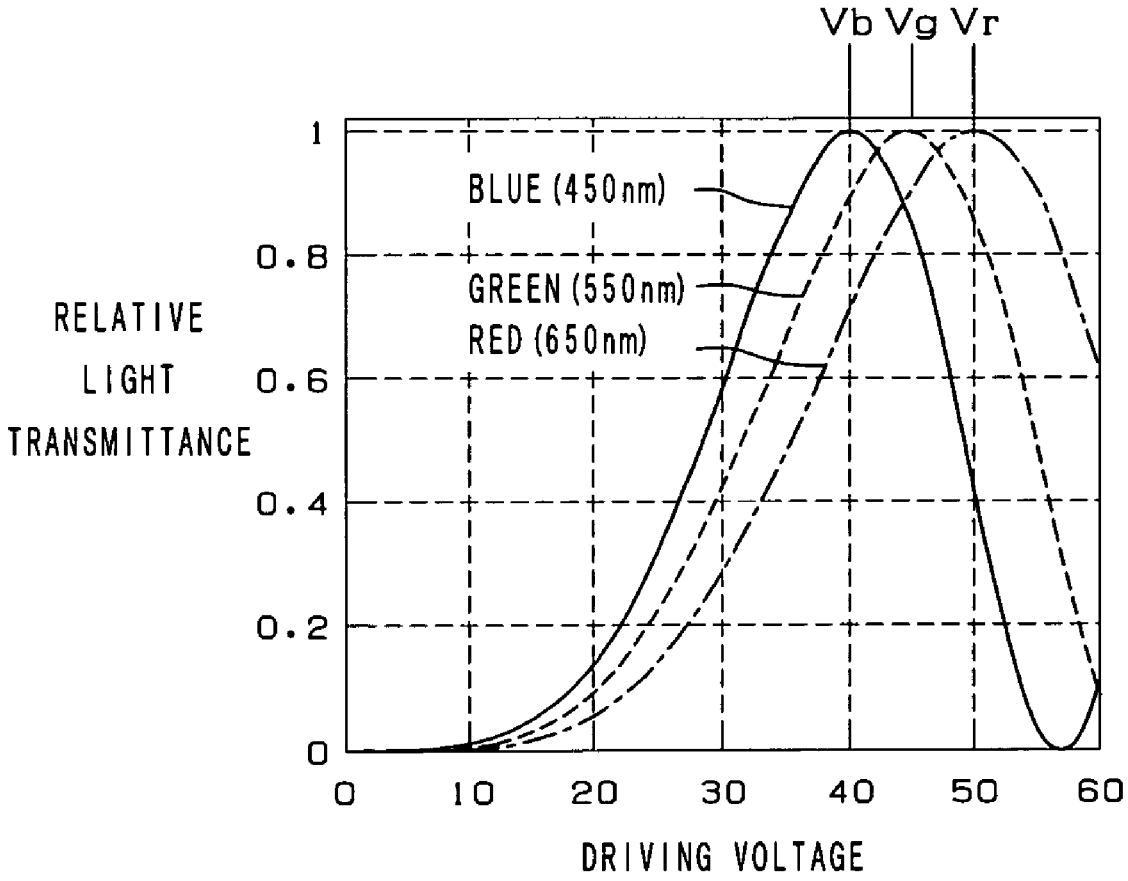
FIG. 11 is a graph which shows the relationships between driving voltage applied to a light shutter element and red light transmittance, between driving voltage and green light transmittance and between driving voltage and blue light transmittance.

First, the high-voltage driver which drives the individual electrodes is set to apply the highest voltage Vr of the half-wave voltages Vr, Vg and Vb (see FIG. 11) for the colors R, G and B. The voltage applied to the common electrode is switched between 0V, Vr-Vg and Vr-Vb in synchronization with switching between R, G and B.

Thereby, to the light shutter elements, the voltage Vr is applied in writing R data, the voltage Vg is applied in writing G data, and the voltage Vb is applied in writing B data. In this way, high-speed voltage switch is possible.

In the pixels in which the image data are 0 (when the corresponding light shutter elements are to be turned off), voltages of Vg-Vr and Vb-Vr are applied to the light shutter elements in the duration of G data writing and in the duration of B data writing, respectively. However, as is apparent from FIG. 11, the voltages of Vg-Vr and Vb-Vr are at most approximately 10V, and the light shutter elements supplied with the voltages of this extent transmit substantially no light.

Second Embodiment

Figure 6:
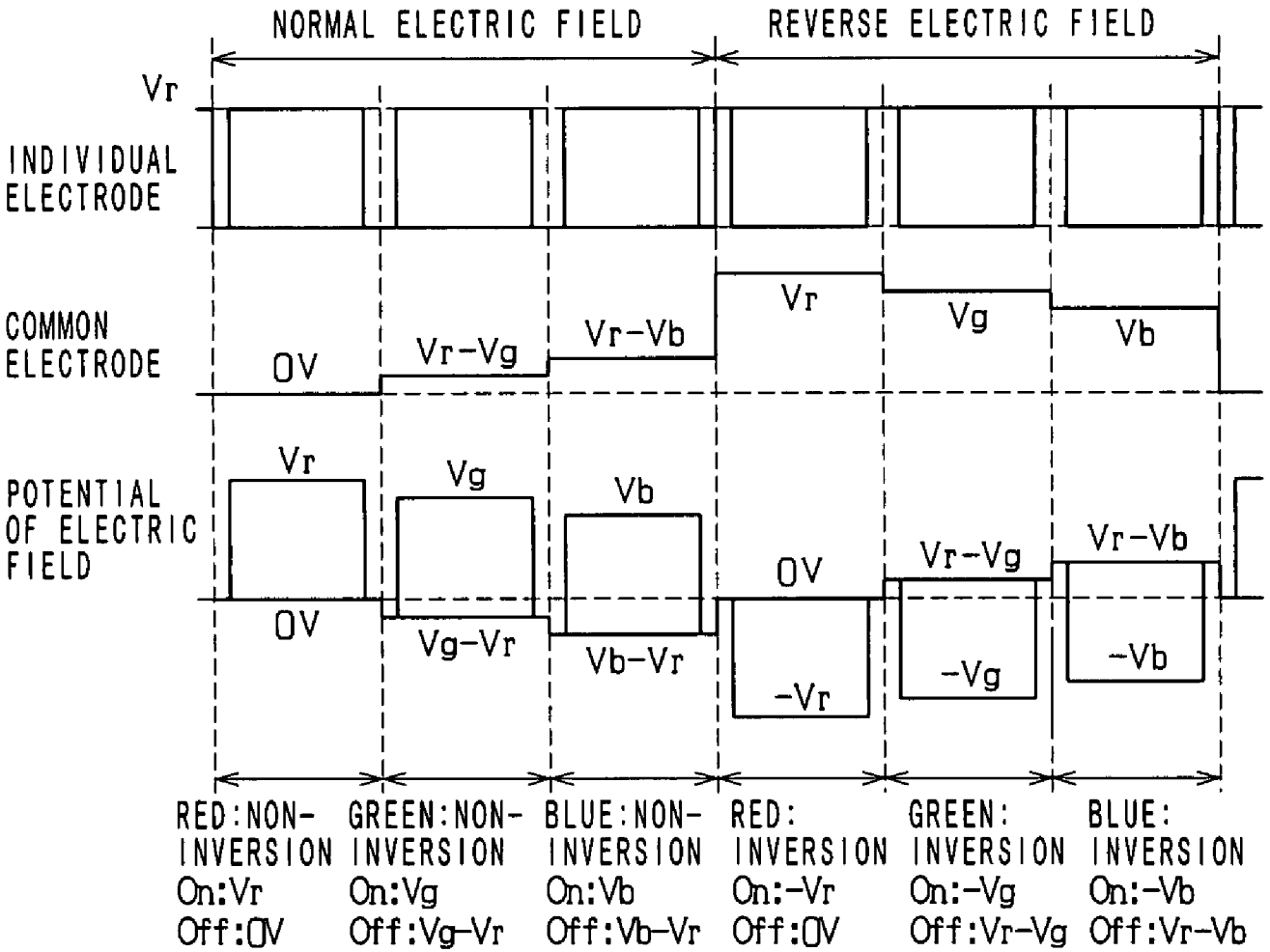
FIG. 6 is a timing chart which shows a second embodiment of a driving method according to the present invention.

As FIG. 6 shows, in the second embodiment, the electric field inversion method is adopted, and the voltage applied to the common electrodes is altered.

When a non-inverted electric field is to act, the voltage application is carried out in the same way as described in the first embodiment. When an inverted electric field is to act, to the high-voltage driver which drives the individual electrodes, the highest voltage Vr of the half-wave voltages Vr, Vg and Vb for the colors R, G and B is applied. Also, the inversion signal is turned on, so that the polarity of image data is inverted. The voltage applied to the common electrode is switched between Vr, Vg and Vb in synchronization with switching between R, G and B.

Thereby, to the light shutter elements, a voltage of −Vr is applied in writing R data, a voltage of −Vg is applied in writing G data and a voltage of −Vb is applied in writing B data. In this way, high-speed voltage switch is possible.

In the pixels in which the image data are 0 (when the corresponding light shutter elements are to be turned off), voltages of Vr-Vg and Vr-Vb are applied to the light shutter elements in the duration of G data writing and in the duration of B data writing, respectively. However, as has been described in the first embodiment, the voltages cause substantially no problems.

Third Embodiment

Figure 7:
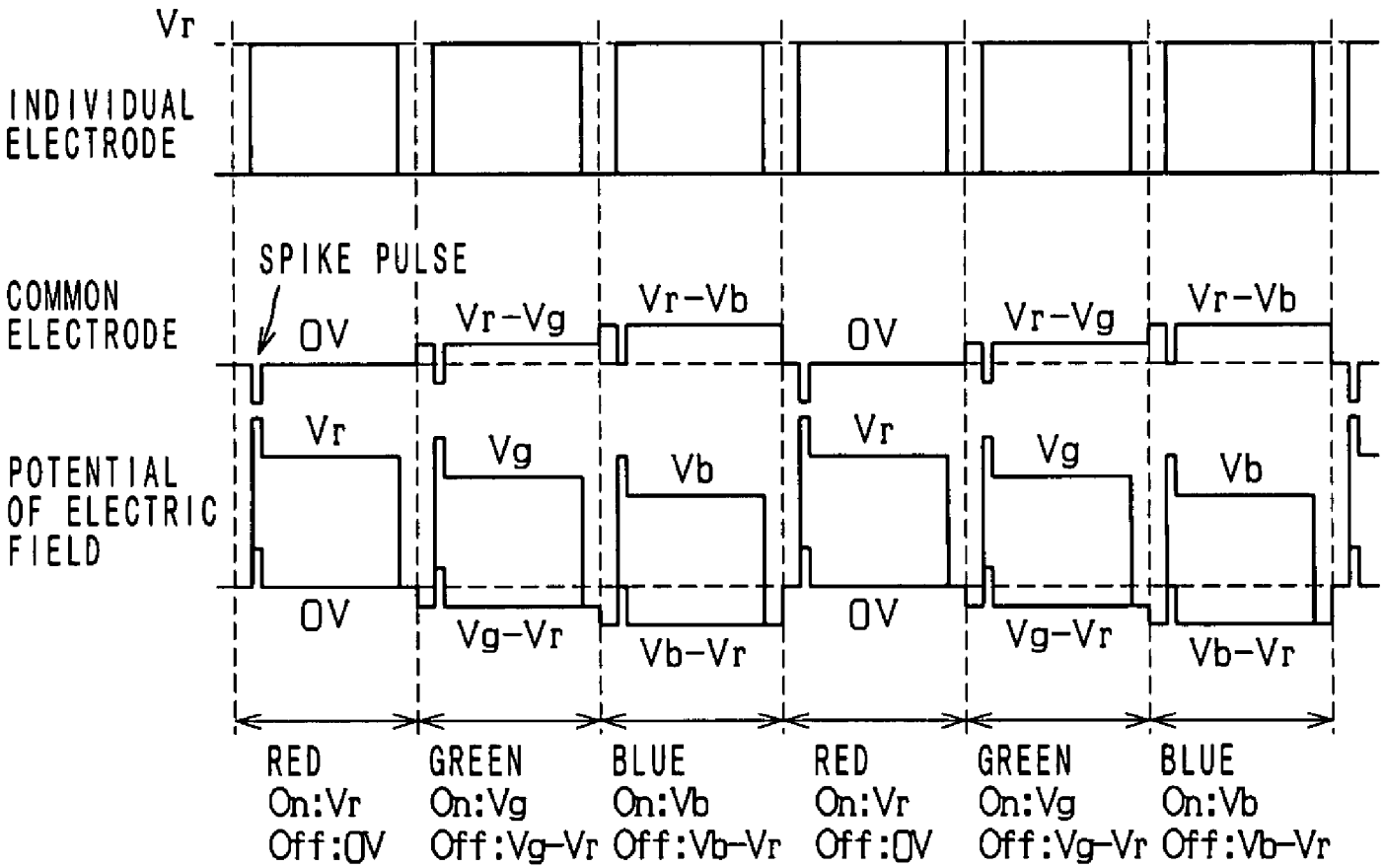
FIG. 7 is a timing chart which shows a third embodiment of a driving method according to the present invention.

As FIG. 7 shows, in the third embodiment, the unidirectional electric field method is adopted as in the first embodiment, and a spike pulse voltage is superimposed.

At the time of starting application of a driving voltage, a spike pulse voltage is applied. The waveform of the spike pulse voltage shall be designed to have a voltage within a range from 5V to 30V and to have a pulse width within a range from 0.1 μsec. to 10 μsec. in accordance with the specification of the light shutter module. By superimposing a spike pulse voltage in synchronization with a start of driving voltage application, the rising characteristic of the driving voltage can be improved, and it becomes possible to set the driving voltage to a lower value.

Fourth Embodiment

Figure 8:
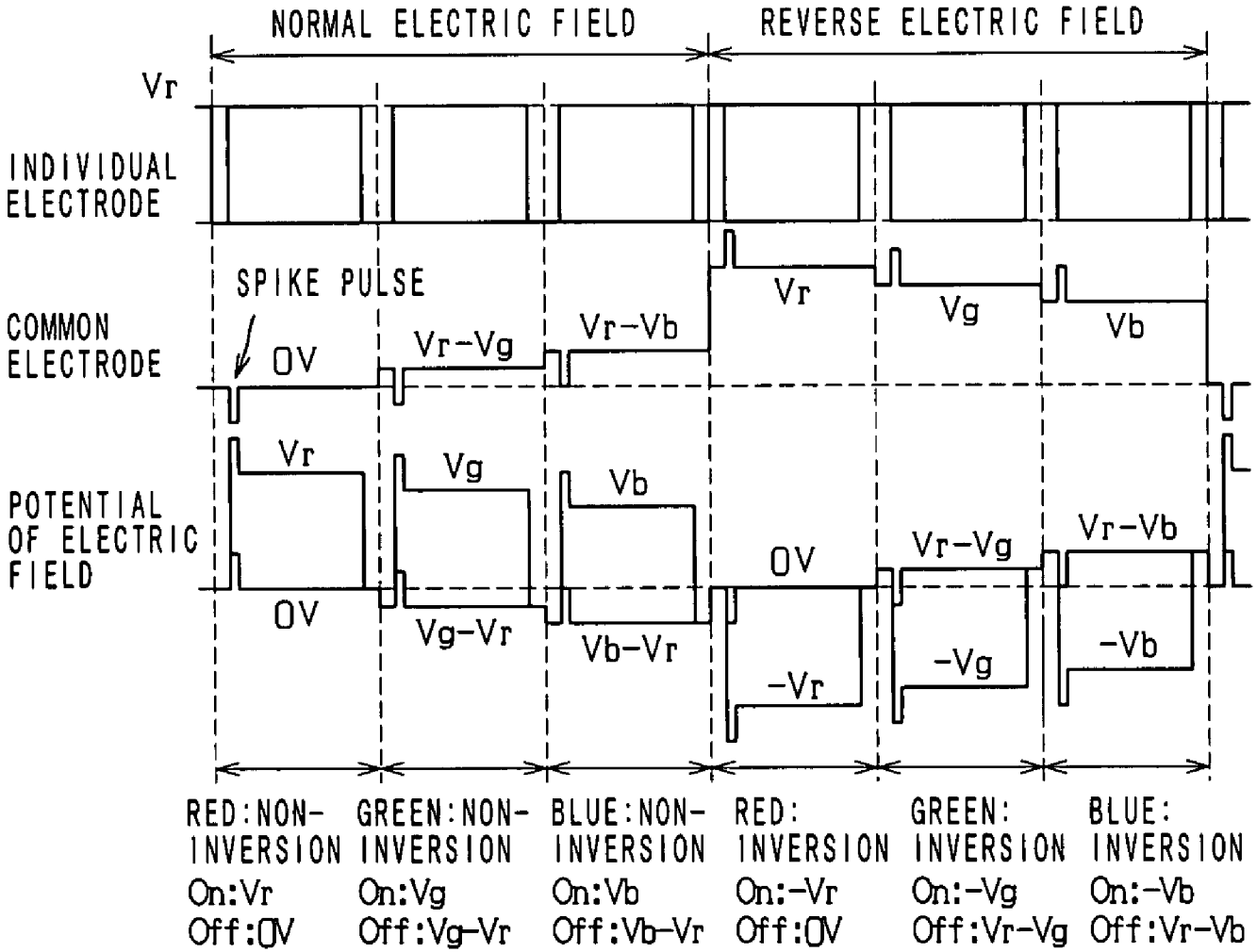
FIG. 8 is a timing chart which shows a fourth embodiment of a driving method according to the present invention.

As FIG. 8 shows, in the fourth embodiment, the electric field inversion method is adopted as in the second embodiment, and a spike pulse voltage is superimposed. The spike pulse is designed and is superimposed in the same way as described in the third embodiment.

Fifth Embodiment

Figure 9:
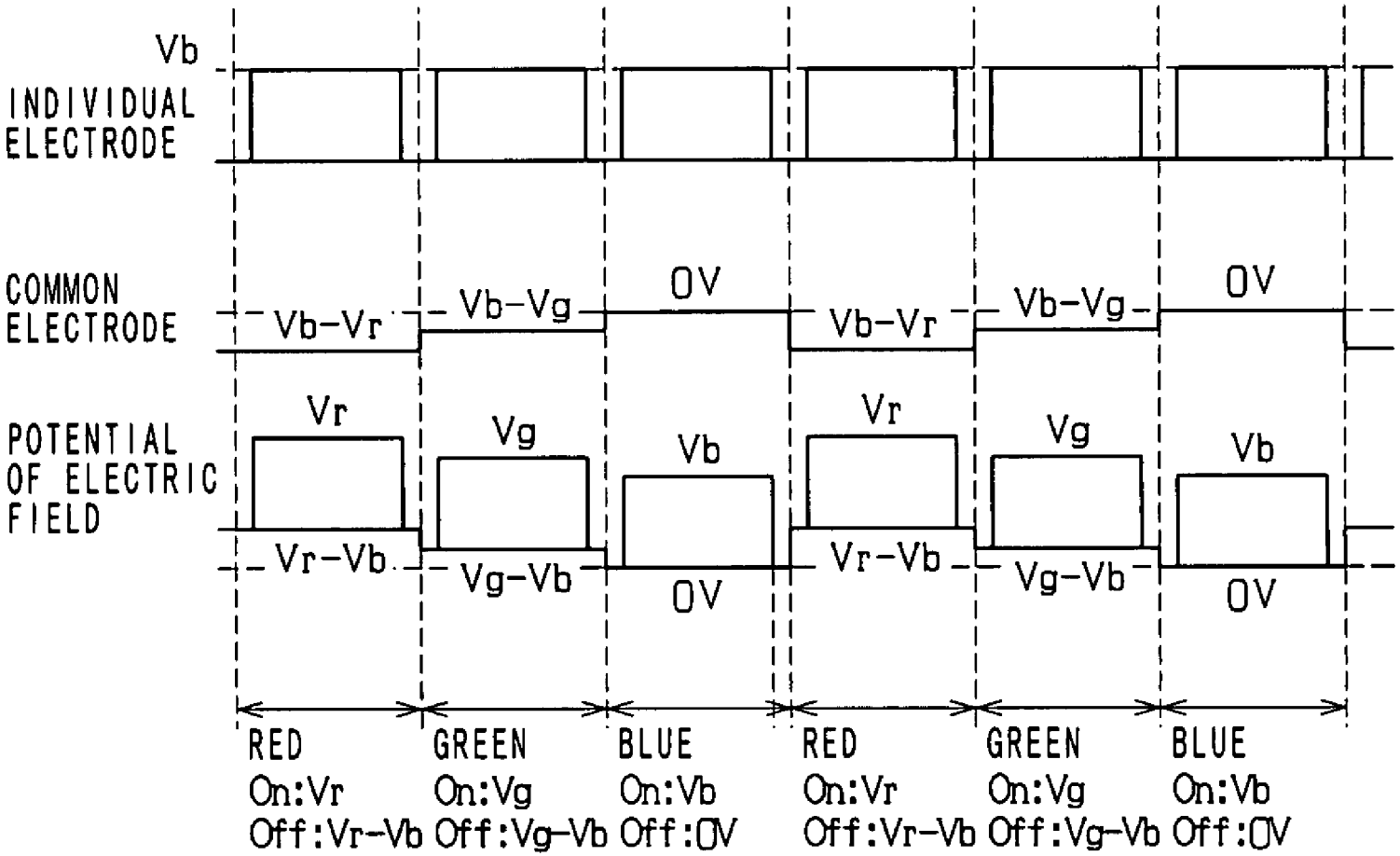
FIG. 9 is a timing chart which shows a fifth embodiment of a driving method according to the present invention.

As FIG. 9 shows, in the fifth embodiment, the unidirectional electric field method is adopted as in the first embodiment, and to the high-voltage driver which drives the individual electrodes, the voltage Vb which is the half-wave voltage for light of B, not the voltage Vr, is applied. The voltage applied to the common electrode is switched between Vb-Vr, Vb-Vg and 0V in synchronization with switching between R, G and B.

Thereby, to the light shutter elements, the voltage Vr is applied in writing R data, the voltage Vg is applied in writing G data and the voltage Vb is applied in writing B data. In this way, high-speed voltage switch is possible.

In the pixels in which the image data are 0, to the corresponding light shutter elements, a voltage of Vr-Vb is applied in the duration of R data writing, and a voltage of Vg-Vb is applied in the duration of G data writing. However, as has been described in connection with the first embodiment, the voltages cause substantially no problems.

Sixth Embodiment

Figure 10:
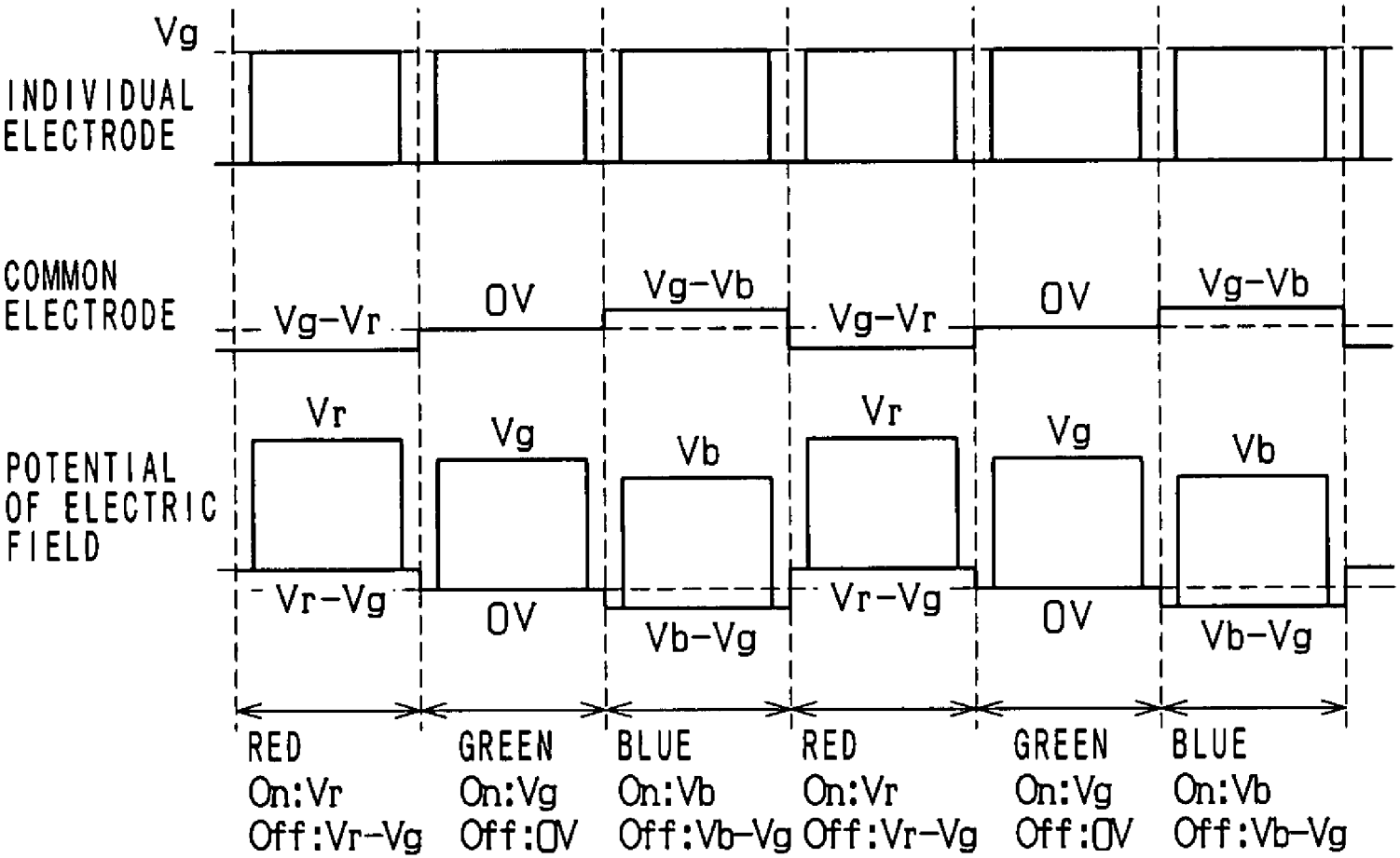
FIG. 10 is a timing chart which shows a sixth embodiment of a driving method according to the present invention.

As FIG. 10 shows, in the sixth embodiment, the unidirectional electric field is adopted as in the first embodiment, and to the high-voltage driver which drives the individual electrodes, the half-wave voltage Vg for light of G, not the voltage Vr, is applied. The voltage applied to the common electrode is switched between Vg-Vr, 0V and Vg-Vb in synchronization with switching between R, G and B.

Thereby, to the light shutter elements, the voltage Vr is applied in writing R data, the voltage Vg is applied in writing G data, and the voltage Vb is applied in writing B data. In this way, high-speed voltage switch is possible.

In the pixels in which image data are 0, to the corresponding light shutter elements, a voltage of Vr-Vg is applied in the duration of R data writing, and a voltage of Vb-Vg is applied in the duration of B data writing. However, as has been described in connection with the first embodiment, the voltages cause substantially no problems.

Other Embodiments

Although the present invention has been described in connection with the preferred embodiments above, it is to be noted that various changes and modifications are possible to those who are skilled in the art. Such changes and modifications are to be understood as being within the scope of the invention.

What is claimed is:

1. A light shutter device comprising:

a light source which emits light of a plurality of colors, switching from one to another in order;

a plurality of light shutter elements made of a material with an electro-optical effect, said light shutter elements controlling in accordance with image data whether to transmit or not to transmit the light which has been emitted from the light source and is incident to the light shutter elements;

a first driver for driving a first electrode of selected ones of said plurality of light shutter elements to a first voltage responsive to said image data; and a second driver for driving a second electrode common to said plurality of light shutter elements, said second driver altering a voltage on the second electrode in synchronization with switching of the colors of the light source;

wherein the first and second drivers operate to invert an electric field acting on the light shutter elements after every cycle of switching the colors of the light from the light source.

2. The light shutter device according to claim 1, wherein: the light source comprises:

a lamp; and a multiple color filter which is located between the lamp and the light shutter elements; and by switching the multiple color filter in order, the light incident to the light shutter elements is switched between a plurality of colors in order.

3. The light shutter device according to claim 1, wherein the second driver operates to superimpose a spike pulse voltage at a start of applying the driving voltage to the light shutter elements.

4. A light shutter device comprising:

a light source which provides light of a color selected from a plurality of colors, and which switches from one color to another in a predetermined order;

a plurality of electro-optical light shutter elements, each selectively transmitting light incident thereon responsive to an electric field applied thereto; and a driver for driving the light shutter elements, said driver altering a driving condition in synchronization with the switching of the colors of the light source;

wherein, the light shutter elements are driven by application of a voltage between a common electrode for all the light shutter elements and individual electrodes for the respective light shutter elements;

the driving condition is altered by altering a potential of the common electrode to alter an electric field acting on the light shutter elements depending on the color of the light emitted from the light source; and the driver operates to invert the electric field acting on the light shutter elements after every cycle of switching the colors of the light from the light source.

5. The light shutter device according to claim 4, wherein the colors of the light emitted from the light source are three primary colors of red, green and blue.

6. The light shutter device according to claim 5, wherein the individual electrodes are set to have a potential corresponding to a half-wave voltage of the light shutter elements for red light.

7. The light shutter device according to claim 5, wherein the individual electrodes are set to have a potential corresponding to a half-wave voltage of the light shutter elements for blue light.

8. The light shutter device according to claim 5, wherein the individual electrodes are set to have a potential corresponding to a half-wave voltage of the light shutter elements for green light.

9. The light shutter device according to claim 4, wherein the driver superimposes a spike pulse voltage at a start of applying a driving voltage to the light shutter elements.

10. An array type writing device comprising:

a light source which emits light of a plurality of colors, switching from one to another in order;

a plurality of light shutter elements made of a material with an electro-optical effect, said light shutter elements controlling in accordance with image data whether to transmit or not to transmit the light which has been emitted from the light source and is incident to the light shutter elements; and a driver for applying a voltage between a common electrode for all the light shutter elements and individual electrodes for the respective light shutter elements to drive the light shutter elements, said driver setting the individual electrodes to have potentials in accordance with image data and altering a driving condition of the common electrode in synchronization with switching of the colors of the light source and operating so as to invert an electric field acting on the light shutter elements after every cycle of switching the colors of the light source.

11. The array type writing device according to claim 10, wherein the individual electrodes are set to have a potential corresponding to a half-wave voltage for light of one of the colors emitted from the light source.

12. A method for driving a light shutter device, comprising the steps of:

making light of a first color from a light source, which is capable of emitting light of a plurality of colors, incident to a plurality of light shutter elements made of a material with an electro-optical effect;

in synchronization with the incidence of the light of the first color to the light shutter elements, setting individual electrodes for the respective light shutter elements to have potentials in accordance with image data by controlling a driver which drives the light shutter elements;

in synchronization with the incidence of the light of the first color to the light shutter elements, setting a common electrode for all the light shutter elements to have a first potential by controlling the driver;

after the incidence of the light of the first color to the light shutter elements, making light of a second color from the light source incident to the light shutter elements;

in synchronization with the incidence of the light of the second color to the light shutter elements, setting the individual electrodes to have potentials in accordance with image data by controlling the driver;

in synchronization with the incidence of the light of the second color to the light shutter elements, setting the common electrode to have a second potential which is different from the first potential by controlling the driver;

after the incidence of the light of the second color to the light shutter elements, making light of a third color from the light source incident to the light shutter elements;

in synchronization with the incidence of the light of the third color to the light shutter elements, setting the individual electrodes to have potentials in accordance with image data by controlling the driver;

in synchronization with the incidence of the light of the third color to the light shutter elements, setting the common electrode to have a third potential which is different from the first potential and from the second potential by controlling the driver; and repeating the steps of setting potentials of said individual and common electrodes in synchronization with the incidents of light of said colors while controlling the driver so that an electric field acting on the light shutter elements has an opposite polarity.

13. The method according to claim 12, wherein the individual electrodes are set to have a potential corresponding to a half-wave voltage of the light shutter elements for light of one of the colors emitted from the light source.

14. The method according to claim 12, wherein the driver inverts an electric field acting on the light shutter elements at specified cycles.

15. The method according to claim 12, wherein the driver superimposes a spike pulse voltage at a start of setting the individual electrodes and the common electrode to have the respective potentials.

* * * * *